US006135297A

United States Patent [19]

DeShazo et al.

[11] Patent Number: 6,135,297

[45] Date of Patent: Oct. 24, 2000

[54] BOTTLE STORAGE AND TRANSPORTATION RACK

[75] Inventors: Bobby D. DeShazo; Steven D. Raupe, both of Oklahoma City, Okla.

[73] Assignee: Eureka Water Company, Oklahoma City, Okla.

[21] Appl. No.: 09/282,667

[22] Filed: Mar. 31, 1999

[51] Int. Cl.[7] ..... A47F 7/00

[52] U.S. Cl. ..... 211/74; 211/59.4; 211/189; 211/85.18

[58] Field of Search ..... 211/59.4, 189, 211/74, 85.18, 85.22, 70.1, 126.16, 126.6, 60.1; 410/47, 49; 248/146, 150, 152; 296/3, 4, 181

[56] References Cited

U.S. PATENT DOCUMENTS

| | | | |
|---|---|---|---|
| Re. 22,507 | 6/1944 | Heigis | 211/75 |
| D. 329,963 | 10/1992 | Schneider | D7/616 |
| 2,746,703 | 5/1956 | Emery | 248/150 |
| 4,175,666 | 11/1979 | Smith | 211/71 |
| 4,382,733 | 5/1983 | Rodgers | 410/49 |
| 4,431,107 | 2/1984 | Bergstrom et al. | 211/49 S |
| 4,506,796 | 3/1985 | Thompson | 211/59.4 |
| 4,898,282 | 2/1990 | Hawkinson et al. | 211/49.1 |
| 4,971,275 | 11/1990 | Roberts | 248/152 |
| 5,370,245 | 12/1994 | Tersch et al. | 211/74 |

*Primary Examiner*—Robert W. Gibson, Jr.
*Attorney, Agent, or Firm*—McAfee & Taft

[57] ABSTRACT

An improved rack for storage and transportation of water cooler bottles is disclosed. The improved rack comprises a plurality of vertical supports at the front and rear of the rack. A plurality of horizontal support bars extend between the front and rear vertical supports. A curved support surface extends between horizontal support bars which are preferably arranged in pairs. The curved support surface may be defined by a cradle, or insert which can be removably attached to a pair of horizontal support bars. The curved support surface will engage an underside of a water cooler bottle placed thereon and will provide ample support thereto to prevent damage to the water cooler bottle during transport.

20 Claims, 6 Drawing Sheets

BOTTLE STORAGE AND TRANSPORTATION RACK

BACKGROUND OF THE INVENTION

The present invention relates to an improved rack used for the storage and transport of water cooler bottles. More particularly, the invention relates to an improved rack which includes a contoured cradle, or insert, which supports filled water cooler bottles to alleviate damage to the water cooler bottles sustained during transport.

The bottled water industry is growing at a rapid rate. More and more businesses and families desire bottled water. To deliver filled water cooler bottles to customers, a large number of the bottles are loaded onto trucks, and each loaded truck must typically make several delivery stops. The water cooler bottles are typically placed in racks which comprise a plurality of vertical rods at the front and the rear thereof. A plurality of horizontal support bars, arranged in pairs, extend from the front to the back of the rack. The horizontal support bars in a pair are spaced such that a water cooler bottle may be supported by a pair of horizontal support bars. When a filled water bottle is delivered, an empty water bottle is picked up. The empty water bottles are generally reused, so long as they are not cracked or otherwise damaged or misused.

As is known in the art, a typical water cooler bottle has raised circular bands around the periphery thereof. The raised bands contact the horizontal bars and the filled water cooler bottles are supported during transport only by that portion of the horizontal support bars contacting the raised bands. A significant number of bottles are damaged since the weight of the filled water cooler bottle is supported by a fairly small contact area. Uneven and bumpy roads can cause the bottles to crack and/or dent at the contact points between the bottle and the support bars. Damaged bottles must be destroyed and cannot be reused and the replacement of damaged bottles constitutes a significant cost. Thus, there is a need for a water cooler bottle storage and transport rack which will provide for the storage and transport of a plurality of water bottles while alleviating the instances of damage to water cooler bottles.

SUMMARY OF THE INVENTION

The present invention is directed to an improved water cooler bottle support and transport rack for holding water cooler bottles during the storage and transport thereof. Water cooler bottles come in a variety of sizes, typically three-gallon, five-gallon and six-gallon bottles. The improved transport rack of the present invention is not limited to a particular size of bottle and will hold and support water cooler bottles of varying sizes. The improved transport rack includes a plurality of vertical supports at forward and rear ends thereof. A plurality of horizontal support bars extend from the forward to the rear vertical supports. The horizontal support bars are arranged in pairs and have a curved support surface extending therebetween. The curved support surface has a radius of curvature equal to or slightly greater than a radius of the outer diameter of a water cooler bottle. When the water cooler bottle is placed on the curved support structure, it will contact the curved support surface along all, or a large portion of the arc length of the curved support surface to support the underside of the water bottle. The curved support surface may be defined on a cradle, or an insert which is adapted to be connected to a pair of horizontal support bars.

The insert preferably has downwardly facing curved hook portions that will be received over the horizontal support bars such that the insert is fixed or supported at the edges thereof by the horizontal support bars. The curved support surface defined by the insert is preferably of a length sufficient to support two water cooler bottles placed end to end. The vertical supports define a plurality of vertical rows, each capable of holding a plurality of water cooler bottles spaced vertically from one another.

When filled water cooler bottles are placed on the curved support surfaces in the improved transport rack, the rack may be placed in a truck or other transport vehicle. Instances of damage to water cooler bottles caused during delivery over rough and uneven roads is alleviated, and can be virtually eliminated as a result of the large surface contact area between the curved support surface and the underside of the water cooler bottles. In other words, the weight of the water in the bottle is spread out over a fairly significant contact area, and over a much greater contact area than with prior art racks. These and other objects and advantages of the present invention will become apparent after studying the detailed description of the invention in view of the accompanying drawings and appended claims.

BRIEF DESCRIPTION OF THE DRAWINGS

FIG. 3 is a left side view of the storage and transportation rack of the present invention.

FIG. 6 is a top view of the cradle of the present invention.

FIG. 8 is a view taken from the direction of line 8—8 in FIG. 4 rotated 90° clockwise. FIG. 8 does not show water cooler bottles.

FIG. 9 shows a prior art water cooler bottle.

DETAILED DESCRIPTION OF A PREFERRED EMBODIMENT

Figure 2:
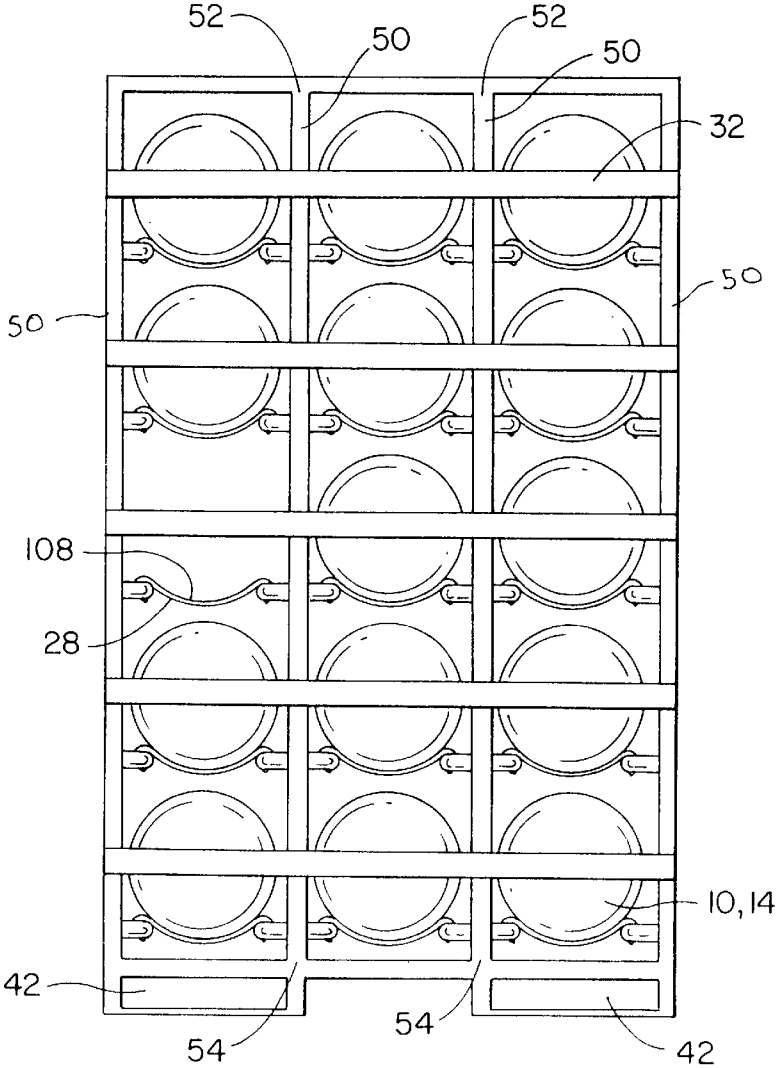
FIG. 2 is a rear view of the improved rack of the present invention having water cooler bottles therein.
Figure 1:
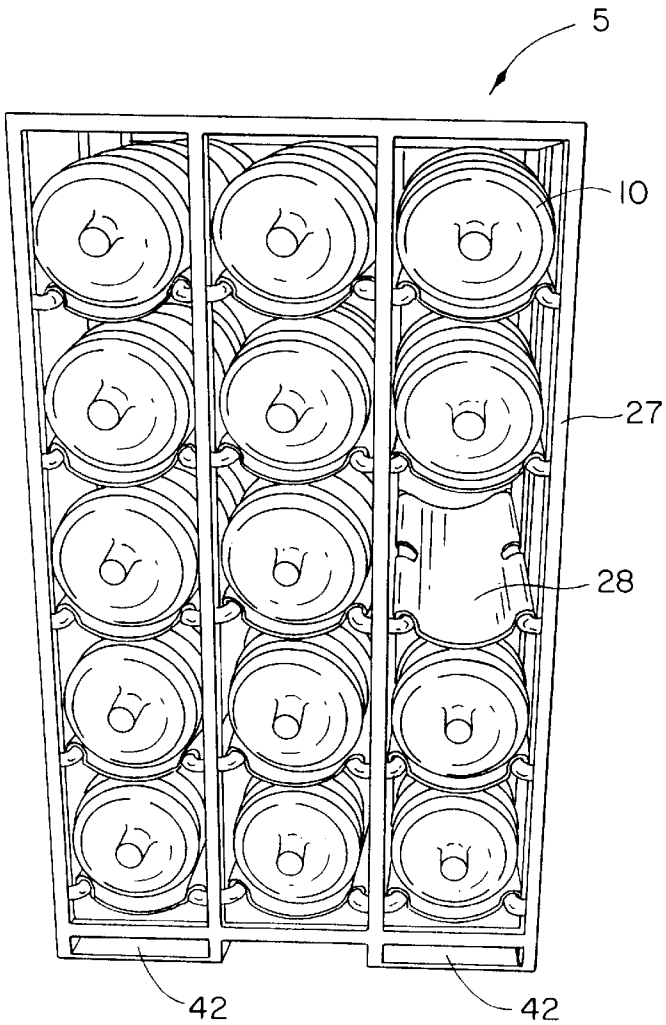
FIG. 1 is a perspective view of the improved storage and transport rack of the present invention having water bottles therein.
Figure 4:
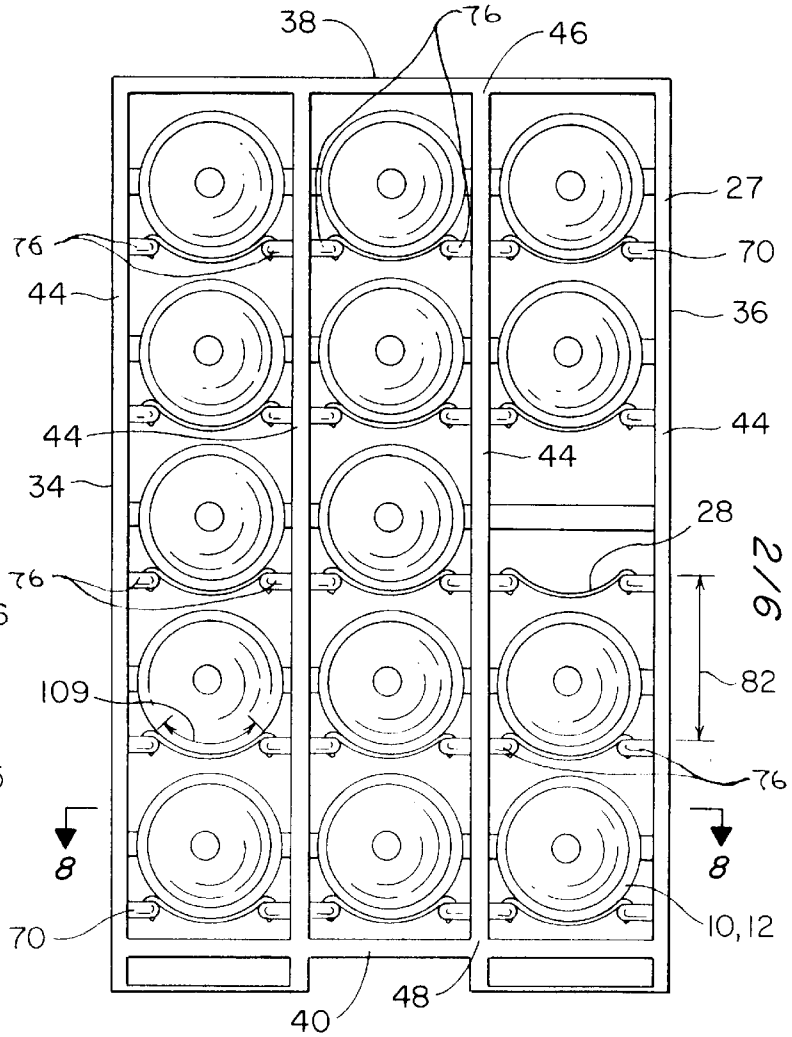
FIG. 4 is a front view of the storage and transportation rack of the present invention.
Figure 5:
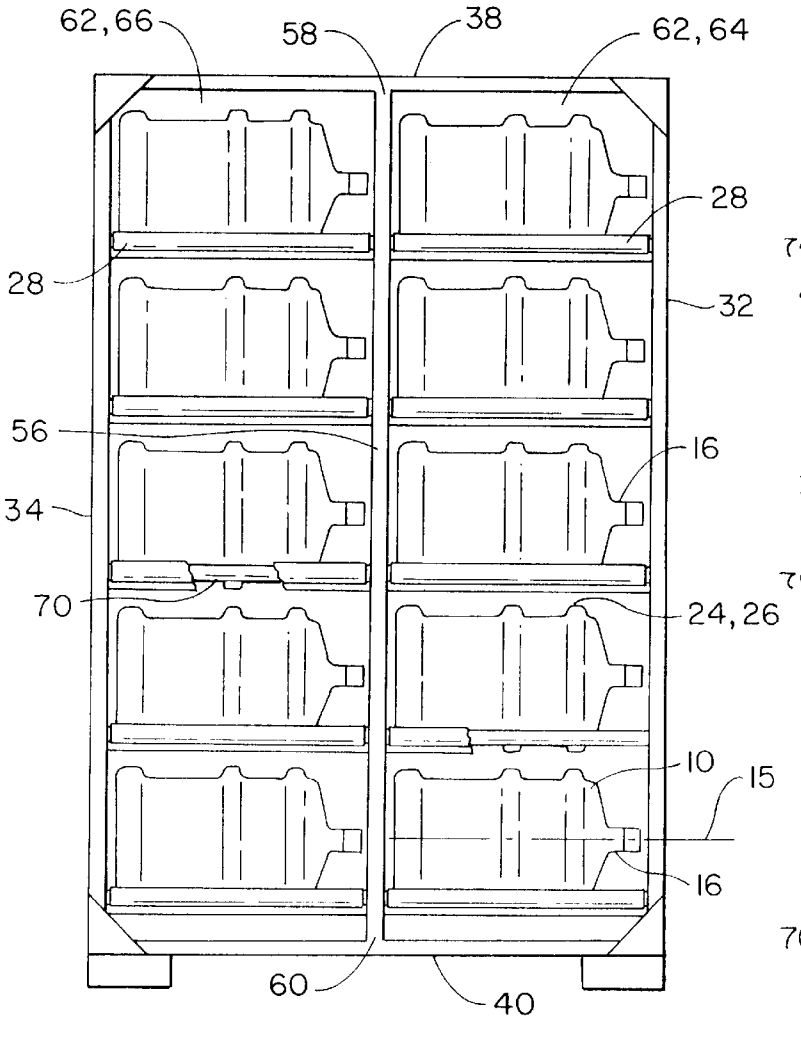
FIG. 5 is a perspective view of the water cooler bottle cradle of the present invention.
Figure 5:
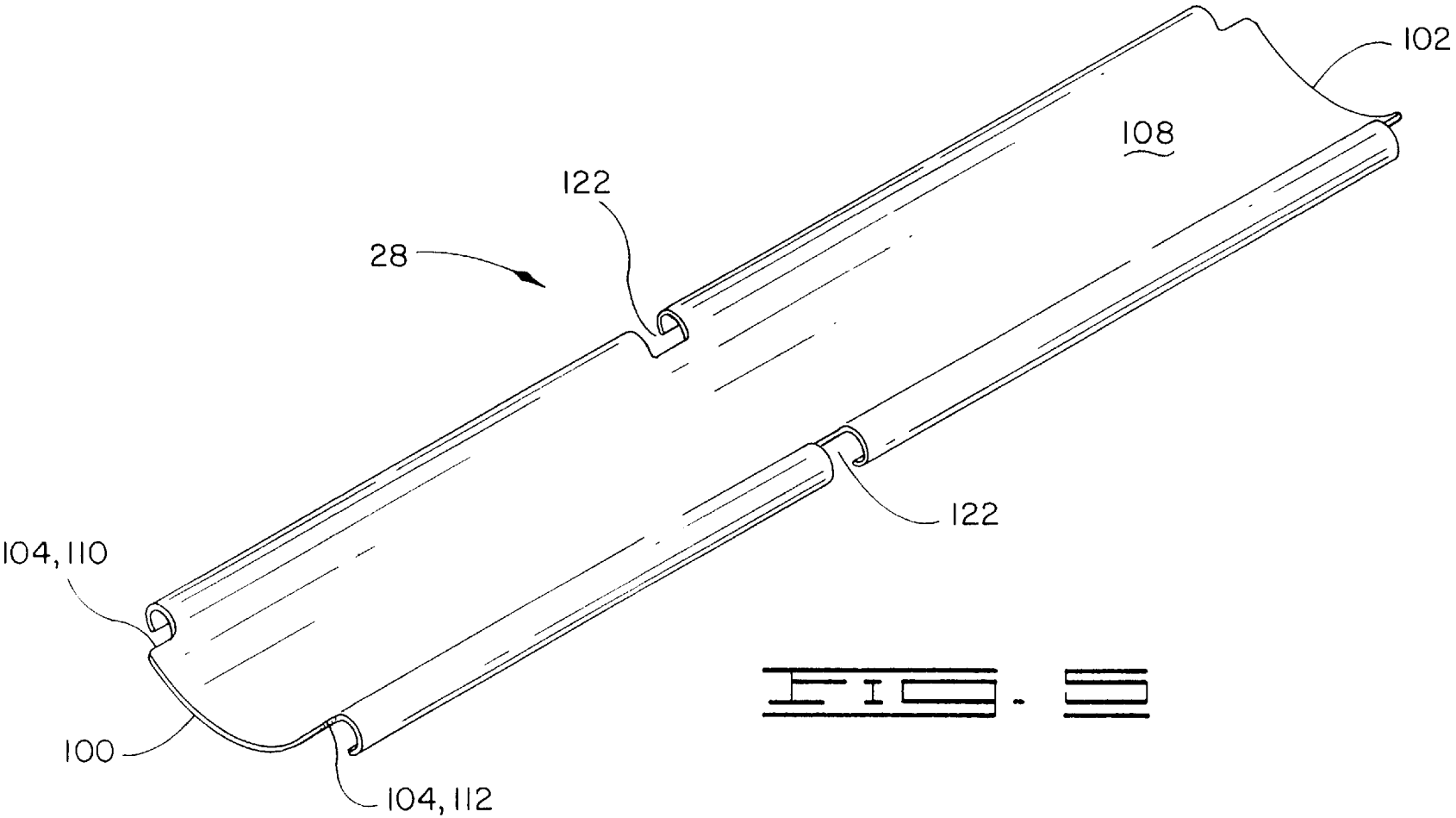
Figure 5:
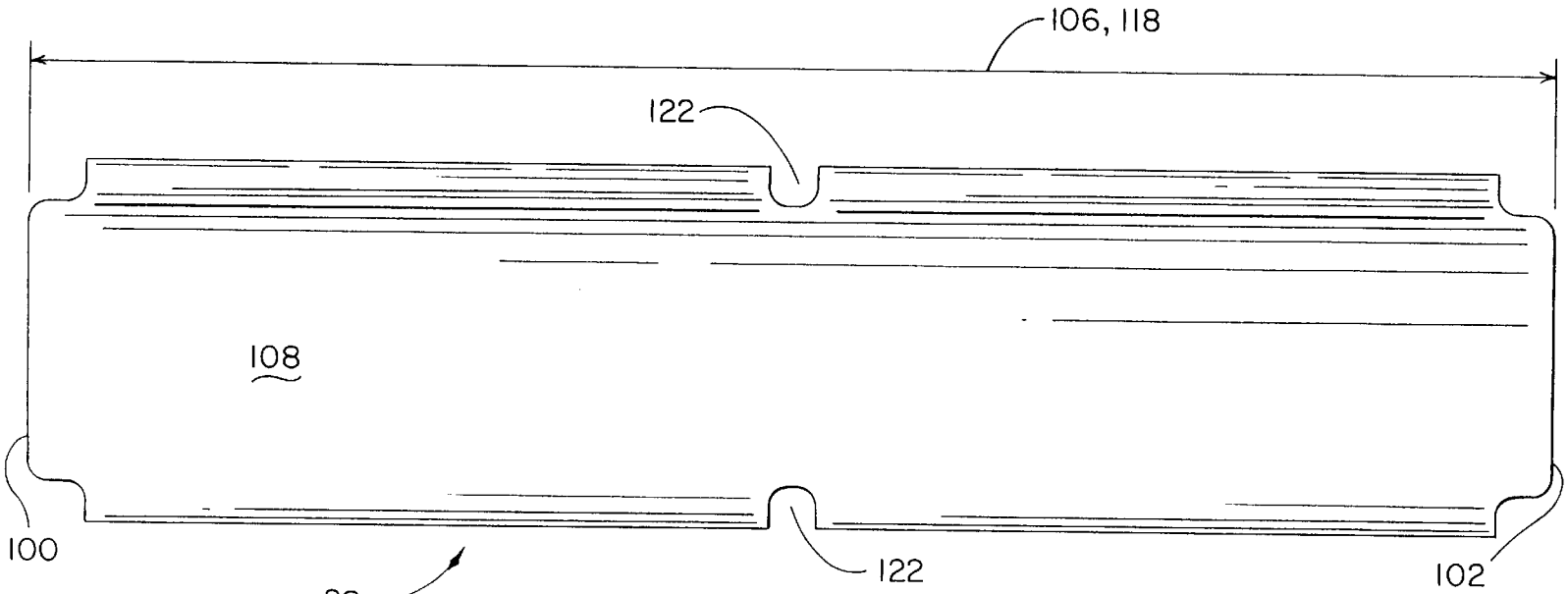
Figure 7:
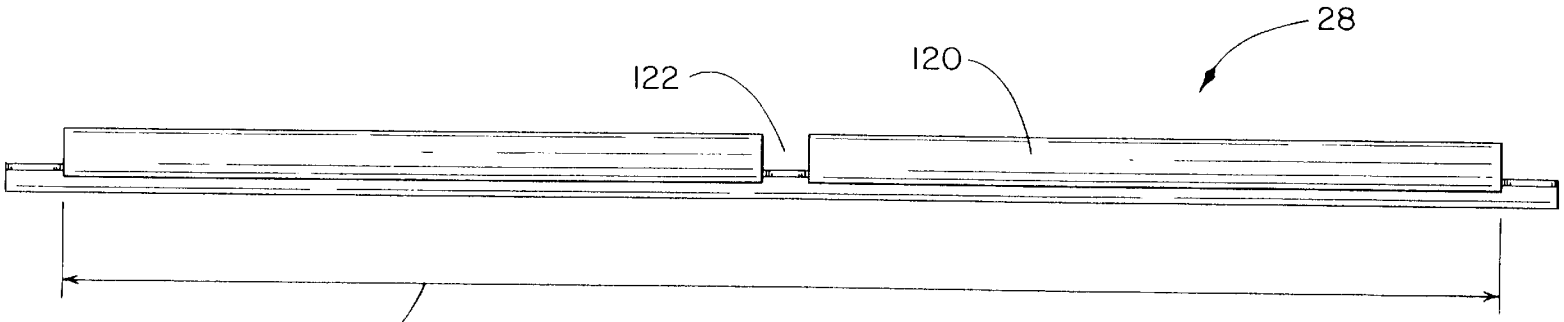
FIG. 7 is a side view of the cradle of the present invention.
Figure 1:
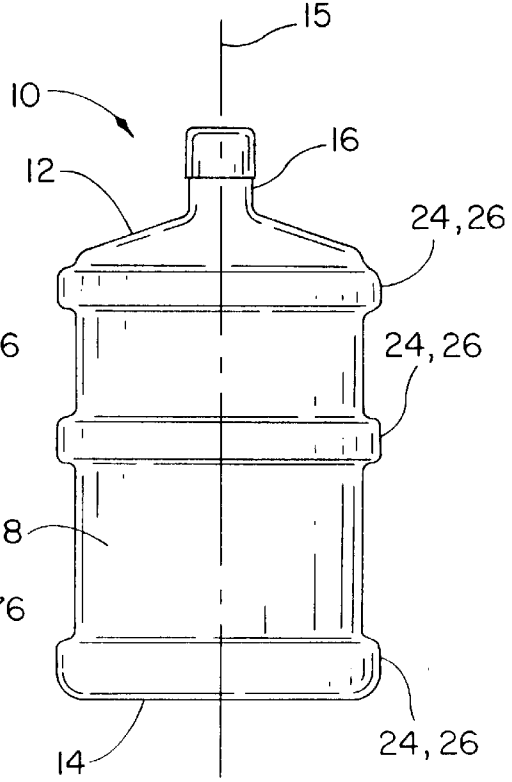
Figure 2:
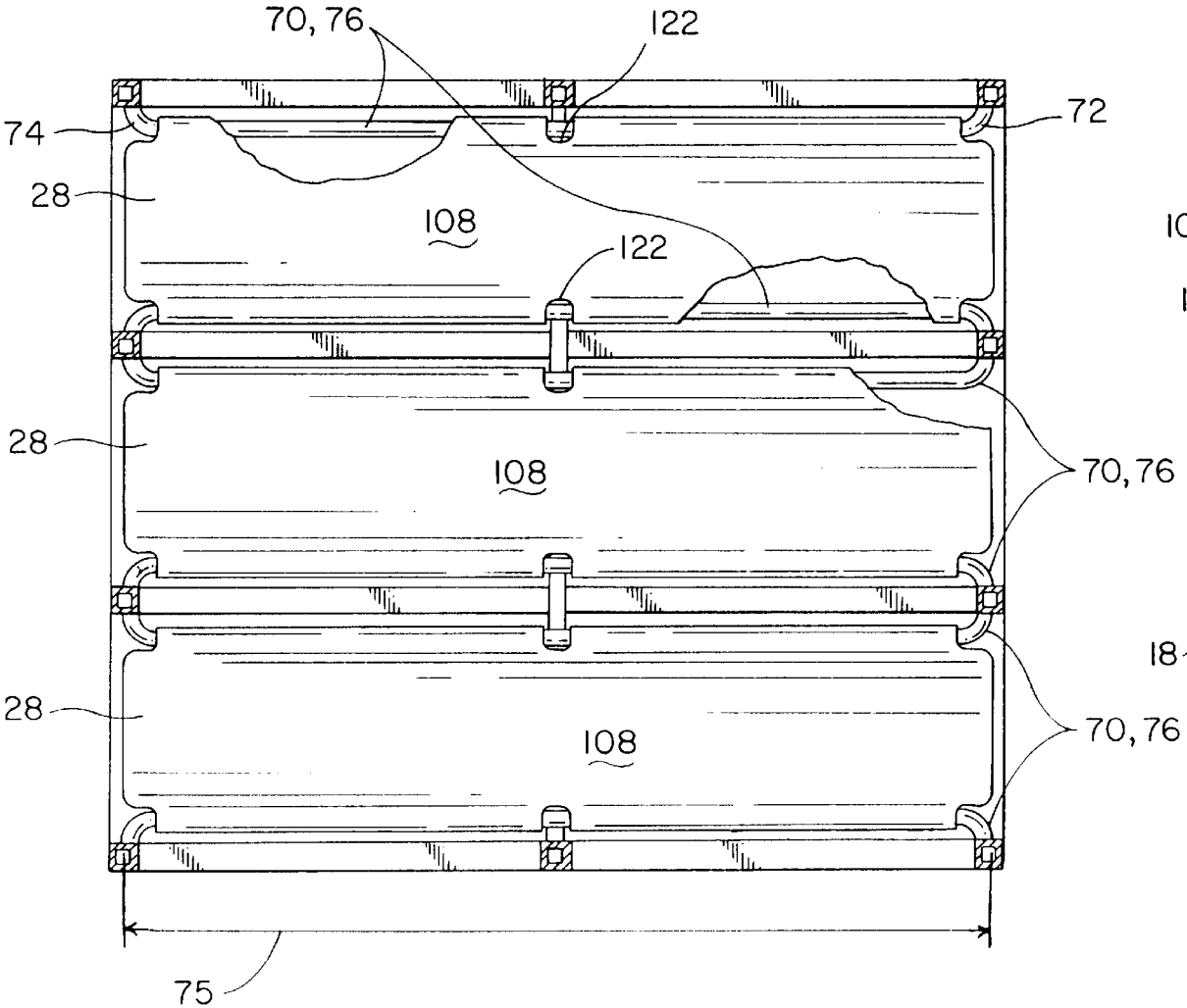

Referring now to the drawings and particularly to FIG. 1, an improved water bottle storage and transport rack 5 is shown. Improved transport rack 5 is adapted to support water bottles 10 during the transport and storage thereof while eliminating or at least alleviating instances of damage to the water cooler bottles during transport.

Improved transport rack 5 is shown with a full load of water cooler bottles 10, except that one bay has been left open for clarity of description. As is well known in the art, bottles 10 are generally cylindrical objects having a first or forward end 12, a rear or second end 14 and a longitudinal axis 15. A neck 16 extends forward from forward end 12. The portion of bottle 10 between ends 12 and 14 may be referred to as a body portion 18. Body portion 18 of bottle 10 has an outer surface 20 defining a first outer diameter 22.

A plurality of circular bands 24, in this case three circular bands 24, extend radially outwardly from outer diameter 22 and have a second outer diameter 26. Improved transport rack 5 comprises a support rack 27 having a plurality of supports or cradles 28 disposed therein for supporting bottles 10.

Support rack 27 is well known in the art. The novelty of the present invention is in the improved storage and transport rack 5 which includes rack 27 and cradles 28 for supporting bottles 10. Rack 27 has a front 30, a rear 32, a left or first side 34 and a right or second side 36. Rack 27 also has a top or upper end 38 and a bottom or lower end 40. A pair of fork slots 42 are defined at the lower end 40 of rack 27. Fork slots 42 are adapted to receive the forks of a forklift or other lifting apparatus so that the rack and any water cooler bottles 10 therein can be lifted and moved for storage purposes, or lifted and placed in a truck for delivery.

A plurality of front, or forward vertical supports or posts 44 having an upper end 46 and a lower end 48 extend from upper end 38 to lower end 40 of rack 27. A plurality of rear vertical supports or posts 50 having an upper end 52 and a lower end 54 extend from the upper end 38 to the lower end 40 of rack 27. Rack 27 has side vertical supports 56 having an upper end 58 and a lower end 60 extending from the top to the bottom of rack 27 positioned between front and rear sides 30 and 32 thereof. Side vertical supports 56 divide rack 27 into bays 62, comprising a front bay 64 and a rear bay 66, each having a length sufficient for receiving a water cooler bottle 10.

Front and rear vertical supports 44 and 50 divide rack 27 into a plurality of rows 68. As is apparent from the drawings, laterally adjacent front vertical supports 44 and corresponding laterally adjacent rear supports 50 define a vertical row 68. As used herein, reference to the lateral direction means the direction from side 34 to side 36. The direction from front 32 to rear 34 may be referred to as the transverse direction.

Rack 27 also includes a plurality of support bars 70, which as shown in the figures are preferably horizontal support bars 70 having a first end 72 and a second end 74 extending from the front 30 to the rear 32 of rack 27. Support bars 70 have a length 75.

Horizontal support bars 72 are preferably arranged in spaced pairs 76. Horizontal bars 72 in a pair 76 have a space 78 therebetween. A length 75 of horizontal support bars 72 is such that two bottles, one in front bay 64 and one in rear bay 66 may be supported by each pair 76 of horizontal rods 72. Each row 68 has a plurality of pairs 76 so that a plurality of water cooler bottles 10 may be stored and/or transported in each row. The pairs 76 are vertically spaced from one another a sufficient distance to provide for clearance between water cooler bottles 10 that are supported by vertically adjacent pairs 76. Thus, pairs 76 have a vertical space 82 therebetween.

Figure 10:
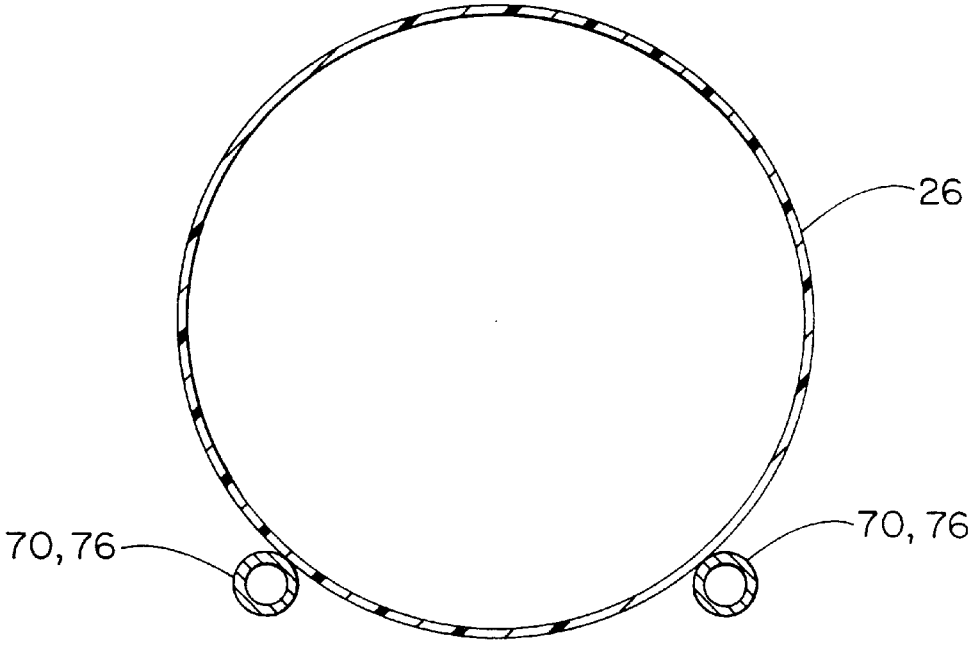
FIG. 10 PRIOR ART
FIG. 10 shows a section view of the outer diameter of a water cooler bottle resting directly on horizontal support bars.
Figure 11:
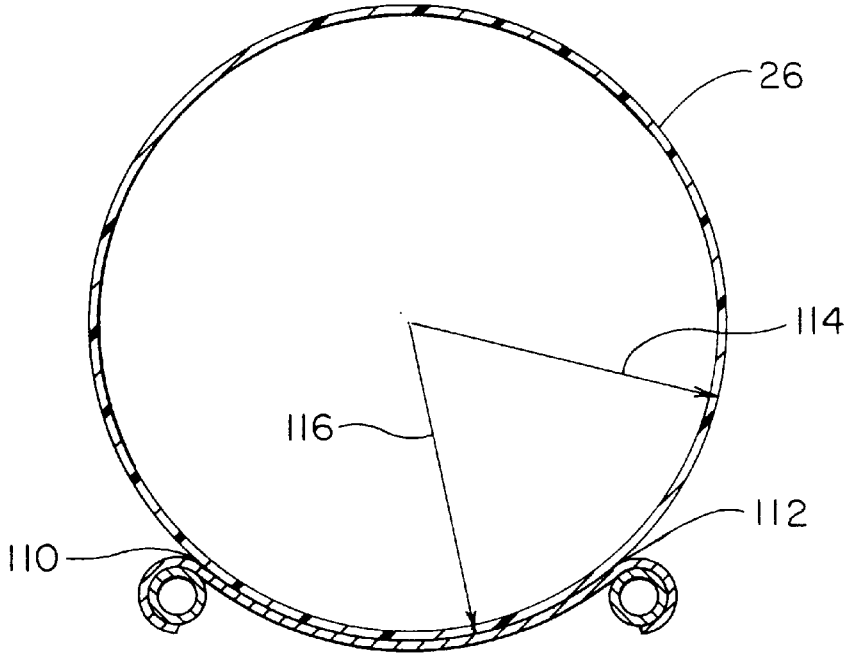
FIG. 11 shows a section view of a water cooler bottle resting on the curved support surface defined by the cradle of the present invention.

Prior art usage of rack 27 comprises placement of water cooler bottles 10 directly on spaced pairs 76 of support bars 72. Bottles 10 would directly contact each support bar 72 in a pair 76 at the location of circular bands 24. FIG. 10 depicts a section view of a bottle 10 resting directly on bars 72. As shown therein, a bottle 10 will contact bars at the outermost diameter of the bottle which generally comprises each location where a circular band 24 is present. Thus, with the prior art manner of using a rack 27, the weight of a filled water cooler bottle was supported by the minimal contact area between raised circular bands 24 and bars 72. Such a contact area is not always sufficient to adequately support a filled water cooler bottle, and the water cooler bottle is damaged at the contact area during transport. This problem is alleviated, and may be virtually eliminated, by the improved transport rack 5 which provides for a curved support surface extending between horizontal rods 72, thus giving greater support to the water cooler bottles. The added support alleviates, and virtually eliminates damage to water cooler bottles 10 during storage and transport.

Improved transport rack 5 includes a curved support surface extending between horizontal bars 72 in a pair 76 to provide support to each bottle 10 placed in improved rack 5. Improved transport rack 5 preferably comprises a plurality of of inserts, or cradles 28 adapted to be attached thereto to provide support to bottles 10. Cradles 28 may be made from numerous materials, such as metal or plastic, but preferably is comprised of a plastic material. Cradle 28 has first and second ends 100 and 102, and outer edges or sides 104 which comprise first and second edges 110 and 112, respectively. Insert 28 has a length 106 extending between ends 100 and 102. Cradle 28 defines a curved support surface 108. Curved support surface 108 has an arc length 109 extending between the edges 110 and 112 thereof. Curved support surface 108 extends between edges 110 and 112 along the length 106 of cradle 28 and has a radius of curvature 116. Radius of curvature 116 is preferably equal to or slightly greater than a radius 114 of the outer diameter of bottle 10, which in this case is diameter 26 of bands 24.

Curved support surface 108 extends between the bars 72 in a pair 76 and will support water cooler bottles 10 along an underside thereof. Support surface 108 will contact bottles 110 along the outermost diameter thereof, in this case outer diameter 26 of circular band 24, for all or at least a substantial portion of arc length 109. Thus, the cradle has a dramatically increased contact area over prior art racks so that the weight of a filled water cooler bottle is distributed over a greater surface area, and is not carried by the point contacts between horizontal bars 72 and the raised bands 24 as with prior art racks.

A length 118 of the curved support surface is sufficient to support two water cooler bottles 10 placed end to end. In the embodiment shown, length 118 and length 106 are identical. If desired, shorter cradles may be used. It is desired that in any case the cradle be of a length such that the curved support surface extends along at least a portion of the length of an individual bottle 10, and preferably is long enough to extend a sufficient distance to support a bottle 10 along the underside thereof at at least two circular bands 24 and more preferably at all of the bands 24 defined on a water cooler bottle 10. Thus, the length is preferably sufficient to extend the full length, or almost the full length of the body portion 18 of a bottle 10.

A means for attaching cradle 28 is also included. The means for attaching may comprise a hook, or hook portion 120 defined at the outer edges 110 and 112 of curved support surface 108. Hooks 120 extend outwardly from edges 110 and 112 of curved support surface 108 and preferably extend along a substantial portion of the length 106 of cradle 28. Hooks 120 preferably define a generally downwardly facing curved hook that can be easily positioned over the horizontal support bars 70. Each hook portion 120 includes a notch 122 to provide clearance for side vertical posts 56. A length 124 of hooks 120 is less than the length 70 of horizontal support bars 72 so that the hooks can be easily placed over horizontal bars 72 without interfering with the vertical supports at the front 30 and rear 32 of transport racks.

Thus, the improved transport rack 5 comprises a plurality of curved supports fixed, or supported at the outer edges thereof so that a water cooler bottle 10 placed thereon will engage the curved support surface along a sufficient contact area to prevent damage thereto during transport. In the embodiment shown, the support surface extends laterally between horizontal rods 70 in a pair 76 of horizontal support and has a length sufficient to support two water bottles located end to end in the cradle.

The operation of the present invention, and the advantages provided by the improved rack are apparent from the drawings. The improved transport rack 5 can be lifted utilizing a forklift or other means and placed into a truck or other transport vehicle with a full load of water cooler bottles 10 placed on cradles 28. Because of the amount of contact area between the bottles 10 and the curved support surfaces 108 defined by cradles 28, there is little likelihood that any water cooler bottles will be damaged due to the jarring that occurs when the bottles are transported over rough and uneven roads. Thus, the water cooler bottle cradle and the improved rack 5 which includes the cradle are improvements over prior art racks and provide distinct advantages thereover.

Thus, the present invention is well adapted to carry out the objects and advantages mentioned as well as those that are inherent therein. While numerous changes may be made by those skilled in the art, such changes are encompassed within the scope and spirit of the present invention as defined by the appended claims.

What is claimed is:

1. A cradle for supporting a water cooler bottle in a water cooler bottle transport rack, the rack being comprised of a plurality of horizontal support bars arranged in spaced pairs, said horizontal support bars being rigidly supported at the ends thereof, the cradle comprising:

a curved support surface for supporting said water cooler bottle; and attachment means for connecting said curved support surface to one of said pairs of horizontal support bars, wherein a water cooler bottle may be placed in said cradle so that said curved support surface will support an underside of said water cooler bottle, said curved support surface having a length such that it will extend along at least approximately one-half a length of a body portion of said water cooler bottle.

2. The cradle of claim 1, said attachment means comprising downward facing hook portions at the sides of said cradle for engaging said horizontal support bars.

3. The cradle of claim 1, said curved support surface having a radius of curvature equal to or greater than a radius of an outer diameter of said water cooler bottle.

4. The cradle of claim 1, said water cooler bottle having a plurality of circular bands defined on an outer surface thereof, wherein said curved support surface engages said circular bands.

5. A water cooler bottle transport rack comprising:

a plurality of said horizontal support bars rigidly supported at the ends thereof and arranged in spaced pairs; and a plurality of said cradles of claim 1 attached to said pairs of horizontal support bars.

6. The rack of claim 5, wherein said cradles are removably attached to said horizontal support bars.

7. A rack for the storage and/or transport of cylindrical objects comprising:

a plurality of forward vertical posts defining a front of said rack;

a plurality of substantially horizontal support bars extending rearwardly from said forward vertical posts; and a plurality of inserts attached to said horizontal support bars for holding and supporting said cylindrical objects, said inserts defining a curved support surface for engaging the arcuate outer surface of said cylindrical objects.

8. The rack of claim 7, wherein said cylindrical objects comprise water cooler bottles.

9. The rack of claim 8, wherein said curved support surface has a length sufficient to hold two water cooler bottles placed end to end.

10. The rack of claim 8, wherein said horizontal support bars comprise a plurality of pairs of parallel support bars, each said insert being connected to a pair of parallel support bars.

11. The rack of claim 10, said curved support having a hook portion at the edges thereof wherein said hook portion engages said horizontal support bars.

12. The rack of claim 8, said rack further comprising:

a plurality of rear vertical posts, said horizontal support bars extending between and rigidly connected to said forward and said rear vertical posts.

13. The rack of claim 12, wherein said curved support surface has a length sufficient to carry two water bottles placed end to end.

14. The rack of claim 8, wherein said curved support surface has a radius of curvature equal to or greater than a radius of an outer diameter of said water cooler bottle.

15. The rack of claim 8, wherein said insert is comprised of plastic.

16. A water cooler bottle transport rack comprising a plurality of horizontal bars rigidly supported at the ends thereof and arranged in spaced pairs, and a plurality of cradles attached to said pairs of horizontal bars, said cradles each comprising a curved support surface for supporting a water cooler bottle and attachment means for connecting said curved support surface to one of said pairs of horizontal support bars, wherein a water cooler bottle may be placed in one of said cradles so that said curved support surface will engage and support an underside of said water cooler bottle.

17. The tack of claim 16, wherein said cradles are removably attached to said horizontal support bars.

18. A water cooler bottle storage and transport rack comprising:

a plurality of vertical rows;

a plurality of cradles for supporting water cooler bottles disposed in each vertical row of said storage and transport rack, the storage and transport rack comprising a plurality of horizontal supports, wherein said cradle has hook members at first and second sides thereof for connecting to said horizontal supports, and a curved surface for supporting the underside of said water cooler bottles.

19. A water cooler bottle rack comprising:

a storage and transport rack comprising a plurality of horizontal supports and having a plurality of vertical rows;

a plurality of cradles disposed in each vertical row for supporting water cooler bottles in said storage and transport rack, each said cradle comprising;

first and second outer sides having a curved support surface defined therebetween for supporting at least one of said water cooler bottles, each said cradle being positionable in a vertical row such that it will support an underside of said bottle and hold said water cooler bottle such that a longitudinal axis thereof is substantially horizontal, said cradle having hook members at said first and second sides thereof for connecting to said horizontal supports.

20. A cradle for supporting a water cooler bottle in a bottle storage and transport rack, the storage and transport rack having a plurality of vertical rows for holding said water cooler bottles, the cradle comprising:

first and second outer sides having a curved support surface defined therebetween for supporting said water cooler bottle, said cradle being positionable in a vertical row such that it will support an underside of said bottle and hold said water cooler bottle such that a longitudinal axis thereof is substantially horizontal; and said storage and transport rack comprising a plurality of horizontal supports, said cradle having hook members at said first and second sides thereof for connecting to said horizontal supports and having a length sufficient to support two of said water cooler bottles positioned end to end.

* * * * *